US005810471A

United States Patent [19]

Nath et al.

[11] Patent Number: 5,810,471

[45] Date of Patent: Sep. 22, 1998

[54] RECYCLED ASPHALT DRUM DRYER HAVING A LOW $NO_X$ BURNER

[75] Inventors: Robert H. Nath, Austin; John Wiley, Leander; Robert Erickson, Georgetown, all of Tex.

[73] Assignee: Cyclean, Inc., San Fernando, Calif.

[21] Appl. No.: 181,445

[22] Filed: Jan. 14, 1994

Related U.S. Application Data

[63] Continuation of Ser. No. 754,264, Aug. 29, 1991, abandoned, which is a continuation of Ser. No. 472,289, Jan. 30, 1990, abandoned, which is a continuation-in-part of Ser. No. 387,160, Jul. 31, 1989, abandoned.

[51] Int. Cl.[6] ..... B28C 5/46

[52] U.S. Cl. ..... 366/25; 34/135; 432/111

[58] Field of Search ..... 34/130–136, 138–140, 34/142, 137; 432/105–109, 113, 117, 111; 366/4, 7, 22–25, 144, 147; 404/77

[56] References Cited

U.S. PATENT DOCUMENTS

| | | | |
|---|---|---|---|
| 3,840,321 | 10/1974 | Moench | 431/11 |
| 3,866,888 | 2/1975 | Dydzyk | 366/25 |
| 3,999,743 | 12/1976 | Mendenhall | 366/25 |
| 4,004,875 | 1/1977 | Zink et al. | 431/9 |
| 4,039,171 | 8/1977 | Shearer | 366/25 |
| 4,089,508 | 5/1978 | Anderson | 366/7 |
| 4,143,972 | 3/1979 | Benson | 366/25 |
| 4,190,370 | 2/1980 | Brock et al. | 366/25 |
| 4,207,062 | 6/1980 | Moench et al. | 366/25 X |
| 4,229,109 | 10/1980 | Benson | 366/24 |
| 4,309,113 | 1/1982 | Mendenhall | 366/25 X |
| 4,378,205 | 3/1983 | Anderson | 431/5 |
| 4,427,376 | 1/1984 | Etnyre et al. | 366/25 X |
| 4,445,843 | 5/1984 | Nutcher | 431/115 |
| 4,505,666 | 3/1985 | Martin et al. | 431/175 |
| 4,541,796 | 9/1985 | Anderson | 431/187 |
| 4,600,379 | 7/1986 | Elliott | 366/25 X |
| 4,659,356 | 4/1987 | Lawhon et al. | 432/111 X |
| 4,838,185 | 6/1989 | Flament | 110/263 X |
| 4,870,912 | 10/1989 | Lee | 432/105 X |
| 4,910,540 | 3/1990 | Murray | 366/25 X |
| 4,913,552 | 4/1990 | Bracegirdle | 366/25 X |
| 4,930,430 | 6/1990 | Allen et al. | 431/285 |
| 4,946,283 | 8/1990 | Musil | 366/25 X |
| 4,955,722 | 9/1990 | Marconnet | 366/25 |
| 4,957,050 | 9/1990 | Ho | 110/346 |
| 4,957,433 | 9/1990 | Swisher, Jr. | 432/118 X |
| 4,957,434 | 9/1990 | Radomsky | 366/25 X |
| 4,969,814 | 11/1990 | Ho et al. | 431/8 |
| 4,989,986 | 2/1991 | Swisher, Jr. | 366/25 X |
| 5,054,931 | 10/1991 | Farnham et al. | 366/25 |

FOREIGN PATENT DOCUMENTS

| | | | |
|---|---|---|---|
| 3003547 | 9/1980 | Germany | 366/25 |
| 2949479 | 6/1981 | Germany | 432/111 |
| 27953 | 2/1984 | Japan | 366/22 |
| 7906432 | 3/1981 | Netherlands | 366/25 |
| 624088 | 8/1978 | U.S.S.R. | 366/25 |

*Primary Examiner*—Charles E. Cooley
*Attorney, Agent, or Firm*—Ronald R. Snider

[57] ABSTRACT

An apparatus for the treatment of 100% reclaimed asphaltic pavement (RAP) uses low temperatures and no direct radiation from a burner flame to the RAP. The RAP is first heated in a counter flow drum which is supplied with hot combusting gases generated by a remote low NOx burner. The temperature of the drum input gases is preferably around 1100 degrees F and the output temperature of the gases may be 100 degrees F or less greater than the input temperature of the RAP. The RAP may be heated with a microwave oven to raise the RAP to a final temperature, although this step is not absolutely necessary in the counterflow design of this invention.

33 Claims, 3 Drawing Sheets

RECYCLED ASPHALT DRUM DRYER HAVING A LOW $NO_X$ BURNER

RELATED APPLICATIONS

This application is a continuation of application Ser. No. 07/754,264, filed Aug. 29, 1991, now abandoned, which is a continuation of application Ser. No. 07/472,289, filed Jan. 30, 1990, now abandoned, which is a continuation in part of U.S. patent application Ser. No. 07/387,160 filed Jul. 31, 1989, now abandoned, entitled Drum Dryer For Reprocessing Recycled Asphalt Pavement, which is owned by the same corporation, Cyclean, Inc. a Delaware Corporation, and which was invented by Robert Nath a co-inventor in this case.

FIELD OF THE INVENTION

This invention is in the field of heating and recycling asphaltic pavement. More particularly, this invention uses a counter flow drum where the hot gases of combustion enter the drum at the same end as the hot asphalt exits the drum. In counter flow designs, the most efficient heating is obtained because the hottest gases are applied to the hottest RAP and the coolest gases are applied to the coolest RAP at the RAP input. In this manner, the temperature difference between the RAP and the gases is maintained as high as possible at any point in the drum.

The field of recycling asphalt pavement (RAP) requires that the process not pollute the atmosphere with hydrocarbons, dust, and other objectionable gases such as nitrous oxides. It is therefore essential to maintain these emissions at an absolute minimum in order to comply with anti pollution regulations in many state and local jurisdictions.

This invention is for production of hot mixed asphalt pavement (HMA) and more particularly where recycled asphalt pavement (RAP) is used in a drum dryer. The field of the invention also encompasses the technology of production of HMA from RAP or virgin materials where there is little or no air pollution in the form of smoking or production of carbon monoxide, or production of $NO_x$ by the burner used to heat the drum.

DESCRIPTION OF THE PRIOR ART

Counter flow drums for heating asphalt are known in the prior art. The existing art however teaches that counter flow is not desirable because hot gases hitting the already heated RAP cause burning, smoking, and degradation of the asphaltic compounds. A successful design must eliminate these problems with known counter flow designs.

U.S. Pat. No. 4,600,379 Elliott shows a counter flow drum which has a burner injecting flame and high temperature gases directly into a veil of virgin aggregate, and asphalt cement is mixed in a second outer drum. The hot gases do not reach the asphalt material.

U.S. Pat. No. 4,522,498 Mendenhall shows a counter flow drum arrangement where a burner is placed at the RAP output end of the drum, but which uses a shroud or cover to protect the asphalt from the high flame heat. This does not permit a veil to move across the input gases, and does not produce a true counter flow where the input gases are applied directly to the exiting RAP. Still further, this design allows the gases to fold back around the shroud and to exit at the same end as does the RAP. The design is therefore not a counter flow because the gases and the RAP are moving parallel to each other at the RAP output end.

U.S. Pat. No. 4,427,376 Etnyre et al shows a drum having a shroud which extends from the RAP out put end almost to the RAP input. This drum like the Mendenhall '498 patent folds the gases back over the RAP so that the flow is parallel at the RAP exit.

U.S. Pat. No. 4,067,552 Mendenhall shows a design where the hot gas burner is at the RAP exit end, but shielded from the exit RAP. The RAP is heated as it moves over heated pipes which separate it from the high heat and infra red radiation produced by the burner.

U.S. Pat. No. 4,229,109 to Benson describes a drum dryer having a burner located remotely from the drum dryer. Hot gases are recycled through the partially open system. Gases are removed from the output end of the drum, and are fed back to a burner and exhaust. The ratio of exhaust to burner use of the gases is determined by the amount of recycled gases which are required to cool the burner produced gases. The heat source 27 receives fresh air for combustion and recirculated gases. The recirculated gases are kept separate from the combustion fresh air which supplies the oxygen to the burner flame. The recirculated gases are combined with burner produced gases down stream from the burner.

The temperature of the heated gases 25 is controlled by the amount of recirculated gas. The patent teaches that the position of the openings for the recirculated air should be located down stream, just forward from the termination point of the combustion flame (Col 8, 38–50). Benson teaches away from the insertion of the recirculating gases before the burner flame for the purpose of cooling the flame and reducing $NO_x$.

Benson teaches that his apparatus may be used for recycling of bituminous pavement or using a combination of old pavement and new aggregates and bituminous binders (Col 9, lines 50–57).

Benson also teaches that the asphalt at the drum output is at a final temperature which is ready for use in road construction. The invention of this application allows that there may be another heating step, such as microwave heating to bring the output of the drum dryer up to a temperature which is usable.

U.S. Pat. No. 3,866,888 Dydzyk, shows an asphalt pavement drum which includes a recirculating duct 34 and a burner which is attached to the rotary drum.

Other prior art known to applicant includes many examples of asphalt pavement drums which have the burner attached to them and where flame is inserted into the drum. Use of gas flow which is parallel to the flow of asphalt through the drum is also shown in the prior art. The following patents illustrate the state of the art. U.S. Pat Nos. 4,309,113, Mendenhall; 3,614,071, Brock; 4,504,149, Mendenhall; 4,522,498 Mendenhall, 4,277,180, Munderich; 4,481,039, Mendenhall; 4,255,058, Peleschka; 4,462,690, Wirtgen; and 4,361,406, Loggins et al.

In drum dryers of the prior art, flame is introduced directly into the drum and passes within the drum often in direct contact with the asphaltic compounds. The CO formed in the burner is not combined with other gases because as the combustion products hit the wet asphalt, the temperature is rapidly decreased below the level at which CO combustion occurs. As a result, CO remains in the exhaust gases of the drum and is released to the atmosphere. There are also frequently occurring operating conditions that produce uncombined carbon particles and steam cracked hydrocarbons from the asphalt or fuel, resulting in smokey opaque exhaust.

The drum dryers of the prior art also fail to eliminate the production of $NO_x$ because the high heat portion of the flame is not limited by the introduction of a cooling gas. Instead, in a prior art drum, the flame extends for some distance into the drum creating a large region where the temperatures are high enough to form $NO_x$. Even after the flame is extinguished, there still exist high heat conditions where $NO_x$ may be formed. In prior art drums where the flame or combusting gases strike the bituminous compounds, burning and smoking of the asphalt occurs which produces CO as a product of incomplete combustion. CO is also produced by the burner flame and there no combustion chamber to assure combination of the CO with other materials. This pollutes the atmosphere with the CO, NOx, and smoke from the burned bituminous compounds. The drum dryers of the prior art fail to eliminate steam stripping even with reduced entrance temperatures because the parallel flow design, or variations of that, created the simultaneous presence of steam, hot gases and RAP or asphalt in certain zones of the drum. This caused steam cracking of the larger molecules with less volatility into smaller molecules that created an oily vapor in the exhaust that was a major cause of exhaust stack opacity not acceptable by current environmental standards.

BRIEF DESCRIPTION OF THE PREFERRED EMBODIMENT

In this counter flow invention, the hot gases from the burner are passed through a pipe or a pipe having a dog leg which permits some cooling of the gases and reduction of infra red radiation. This provides a drum input gas temperature which is around 1100 degrees F. The control of the input temperature is accomplished by measuring the exhaust gases and material output, and adjusting for pollution effects such as smoking or RAP degradation. The invention may also use ambient air which is mixed with the combustion gases for the purpose of lowering the temperature of the drum input gases.

If the gases are passed through a pipe directly in line with the drum axis, then baffles will be used to smooth out the temperature gradients, laminations or spikes, and to shield the drum from infra red radiation.

The rate of RAP travel through the drum is controlled by the angular velocity and the angle of the drum. A steeper drum angle is with respect to horizontal provides a faster through flow for a given rotational rate. In this invention, the drum longitudinal angle control mechanism may be controlled by measurements of the flow rate, the exiting air temperature, the temperature of the exit RAP, and or desired RAP dwell time in the drum. Control may be established as a function of any or all of the above parameters when the functions are controlled by a computer which can determine the drum angle which is required for a specific desired state of conditions. The computer can be programed by empirically generating curves which are a function of the particular RAP drum which is used.

It is an object of this invention to produce a RAP treatment process which can recycle over the road or "on the go" train operations which produce hot mixed asphalt (HMA) and at the same time provide a clear exhaust and meet Environmental Protection Agency (EPA) emission standards.

The drum of this invention may also be used with a combined feed of RAP and virgin asphalt materials to meet requirements for a mix design which is different from that of the output when pure RAP is the input.

In this invention, it is also an object to provide a microwave treatment system which is down stream from the counterflow drum for the purpose of producing an enhanced asphaltic compound. It is generally accepted that microwave treatment will improve the performance characteristics of asphaltic binders.

It is also an object of this invention to provide a RAP drum in parallel with a virgin asphalt continuous mixing means such as a pug mill.

It is a further object of this invention to provide a cool flow drum (counter flow or parallel flow) where the exhaust gases are directed through the burner of another drum. The second drum burner acts as an incinerator or hydrocarbons which are in the exhaust gases which are applied to it. The second drum is preferably one which receives virgin aggregate as an exhaust coolant, thus super heating the virgin aggregate which is then mixes with the separately heated RAP to form a combined mix.

The counter flow drum of this invention may incorporate polymers as are found in scrap plastics in the mix. Heating of the polymers in the air flow of the drum is possible because the cooler entrance air temperatures permit heating without coking or other degradation. Heating larger polymers makes then susceptible to mechanical break down into shorter polymer chains in a high shear post drum mixer. This permits the use of mixed plastic scrap from waste which is otherwise not usable as an asphalt hot mix enhancer additive.

The counter flow drum having cool flow capability (around 1100 degrees F.) can act as an evaporator unit to remove hydrocarbon and other contaminants from soil with out combusting them. This is particularly important for chlorinated hydrocarbons, PCB'S, dioxins, and other toxic waste. The resultant air stream can be oxidized at high temperature in an afterburner and/or hot catalyzer. The resultant contaminated air stream has not been heated to the extent that the contaminants are partially oxidized into more persistent and/or toxic intermediate products. The exhaust air stream is so cool (below 212 degrees F.) that subsequent refrigeration to precipitate entrained contaminants is minimized if refrigeration is chosen rather than an incinerator.

The cool flow counter flow drum may also be used in combination with a centrifugal separator that concentrates the moisture and hydrocarbon droplets and solid particles in a portion of the exhaust. Exhaust gas treatment systems vary in cost in direct proportion to the volume and mass of the exhaust gas, not the quantity of contaminants contained thereon. For this reason, the use of a cool flow counter flow drum having a low volume of exhaust gases is particularly desirable.

It is another object of this invention to provide flighting in the drum which varies for the purpose of controlling the material veil within the drum. The flighting may allow less exposure at the hot gas input end of the drum than at the center and cold ends.

In this invention, it is also envisioned that the input temperature may be increased above the preferred 1100 degrees F. when virgin rock not having any asphaltic compounds is fed into the gas input stage of the drum.

The Eclipse burner 11 (manufactured by Eclipse Corporation, a division of Eclipse Inc. Rockford, Ill. 61103: Phone 815-877-3031) used with the preferred embodiment is modified to provide for improved $NO_x$ (Nitrous oxide) emissions by rapidly dropping the temperature of the combustion gases emanating from the burner. These burners are nozzle mixing, line type, packaged burners which provide for an efficient means of incinerating fumes and particulate matter. The burners are used with natural gas or propane and are designed for fresh air or recirculating systems. The normal burner flame temperature is approximately 2200 degrees Fahrenheit, a temperature at which nitrous oxide compounds are formed. In the burner as modified for this invention, a supply of recycled gases or other cooling air is inserted immediately ahead of the burner so that the recycled gases immediately cool the combustion chamber and the flame at the burner to a temperature below which $NO_x$ is formed. The recycled gases are inserted ahead of the burner where they mix with the flame. It is believed that keeping temperatures below 1600 degrees Fahrenheit at atmospheric pressure drastically reduces the production of $NO_x$. It is also known that significant $NO_x$ production by automobiles occurs at temperatures in excess of 1800 degrees which may be the minimum temperature for significant $NO_x$ formation. In the embodiment disclosed here in, the temperature of the gases in the combustion chamber 12 are approximately 1500 degrees Fahrenheit.

The recycled gases of this invention may be approximately 50% of the warm gases which exit from the dryer drum when operated in parallel flow. These recycled gases are at approximately 300 degrees Fahrenheit as they exit the drum.

This apparatus also decreases the production of carbon monoxide (CO) by passing the combustion gases through an elongated combustion chamber and a connector pipe before the gases reach the drum dryer. In this apparatus, the carbon monoxide which may be generated by the burner has sufficient time to combine with other gases or oxygen in the combustion region of the burner exhaust. The conversion of CO takes place in the combustion chamber and the hot gas feed pipe to the drum dryer. The gases upon entering the drum have had most of the CO converted to $CO_2$ by combination with other gases, and the $NO_x$ has never been formed. In this invention, the gases reaching the dryer drum are clean gases because they contain minimal amounts of undesirable $NO_x$ and CO.

Smoking of the RAP is eliminated by the limitation of the maximum temperature of the combustion gases at the input of the drying drum. Gases at 1200 degrees rapidly cool when they strike the RAP which has a moisture content of approximately 2% to 5% in the parallel flow embodiments. The moisture is converted to steam which requires a substantial amount of heat, thus lowering the temperature of the gases in the drum input region and reducing the temperature at the RAP. This steam, however can lead to steam cracking of the large molecules which create oily exhaust vapors.

The temperature T1 of the gases (including steam), FIGS. 1 and 2, is measured and is used to control the firing rate of the burner.

If it is desired to change the temperature of the RAP at the exit of the microwave heating unit 29, it may be changed by changing the speed of the conveyor, thus moving the RAP through the microwave field faster or slower thereby producing a change in output temperature. If the RAP is moved faster, the heating will be less because of the reduced time the it is in the microwave treatment region.

If the RAP is slowed down, it will remain in the microwave oven for a greater period of time thus absorbing more heat and raising the temperature of the RAP. This will require that the rate of RAP delivered from the drying drum be reduced in order to have the same amount of RAP in the microwave treatment region. If the rate of RAP supplied by the drying drum is not decreased, there will be more RAP in the microwave region, thus requiring more microwave energy to raise the temperature, or a reduction in temperature because of the increased amount of material.

If all of the microwave energy is absorbed into the RAP, it makes no difference what the amount of RAP on the conveyor is. What is important is the amount of RAP exiting the oven in a given time or the rate of RAP production or flow through the oven. A slow belt with a large quantity of RAP will absorb the same amount of microwave energy as a fast belt with less RAP. In the slow case, the greater quantity of RAP in the furnace heats slower than in the fast case where there is less RAP to heat. For this reason, it is desirable to adjust the microwave energy input to the rate of heating required by varying the rate of material traveling through the oven.

The RAP treatment process of this invention results in the production of high grade asphalt from waste material with very low or no pollution of the air. This is a critical consideration in urban areas such as Los Angeles where there are strict air pollution regulations. The remote burner drum dryer combined with the microwave heater and the bag house filter give this invention a unique capability of producing minimal measurable air pollution. All air and combustion products which enter the recirculating system are eventually exhausted to the atmosphere through the bag house filter. The input for fresh air for the burner is taken from the chamber formed by the microwave tunnel and antennas. This prevents any polluting emissions from the microwave tunnel because all vapors and particles are supplied to the burner for combustion and recirculation in the drum dryer system.

The use of a microwave heating unit as the final heating step of this invention permits the temperature of the RAP to be raised a final increment such as from 250 to 300 degrees without causing smoking. The microwave heats the RAP by heating the rock from the inside and it does not apply excessive heat to the bituminous binder. In the microwave case, the asphalt binder is heated by the heat from the microwave heated rock. If conventional radiation and conduction from fossil fuels is used, the RAP surface is overheated because a large temperature difference is required to transfer the heat to the RAP. The creation of oily exhaust is compounded in the presence of steam on the hot zone of convention heaters.

The ability of microwave heating to raise the temperature of the RAP without raising the temperature excessively makes it possible to produce 300 degree RAP without burning and smoking. Microwave is an expensive process and is impractical where it is necessary to raise the temperature from ambient to the final temperature. Capital costs would increase by a factor of five if only microwave heat is used, making the process prohibitively expensive. This invention solves the problem by using a pollution free drum dryer to raise the initial temperature to approximately 250 degrees, and then using the microwave heater in the temperature range where smoking and burning are produced by conventional fossil fueled burners. Smoking and burning will be produced by fossil fuels because this mode relies upon radiation and convection heating only.

The foregoing and other objects, features and advantages of the present invention will become more apparent in the light of the foregoing detailed description of the preferred embodiments thereof as illustrated in the accompanying drawing(s).

DETAILED DESCRIPTION OF THE PREFERRED EMBODIMENTS

Figure 1:
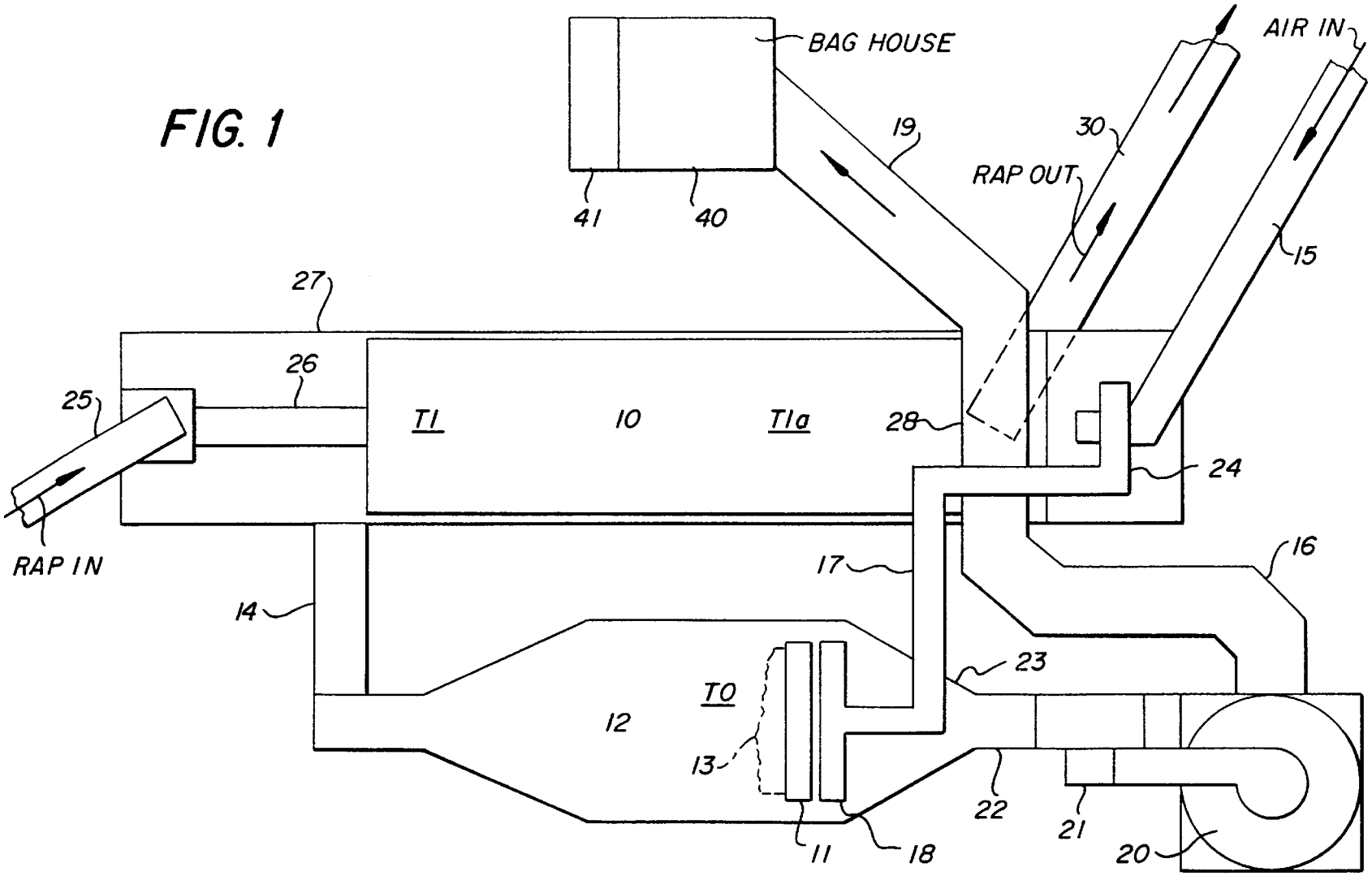
FIG. 1 shows a plan view of a parallel flow RAP drum and separate combustion chamber with input and output connections.

FIG. 1 shows the parallel flow RAP drum 10 and the remote burner 11 which supplies hot gases to the drum. The burner has a combustion chamber 12 which provides for complete combustion prior to inserting the gasses into the mixing drum 10 by pipe passage. The burner flame 13 extends only a short distance into the combustion chamber 12 because of the mix of supply air 15 and the recirculation air from conduit 22. A passage 14 connects chamber 12 to the input end of the drum 27. A fan 24 receives supply air from conduit 15, and forces it to the burner 11 by way of pipe 17 and distribution means 18. The oxygen for the flame 13 is supplied from the fan 17 and conduit 15.

A recirculation conduit 16 takes off approximately 50% of the gas which exits the drum 10. This half of the air recirculates through cyclone cleaner 20 back to the burner box by way of conduit 22. This is the largest quantity of recirculation that can be used and still eliminate water and permit complete combustion by the burner 11. This provides for a very short burning time of the flame 13. The cooling introduced by the large volume of recirculation gases from conduit 16 prevents the flame from reaching a high temperature which is believed necessary for the formation of $NO_x$.

The recirculation conduit 16 has a second branch 19 which is an exhaust conduit which extends to a bag house or other suitable filter means. The gases exiting the drum 10 split between conduit 16 and conduit 19. The baghouse 40 is necessary to remove particles from the gases escaping from the drum in conduit 19 which would otherwise cause significant air and environmental pollution problems at the RAP site. The baghouse receives the portion of the drum 10 exhaust which is not recirculated to the burner 11. An exhaust draft fan 41 pulls gases through conduit 16 and into the baghouse 40.

The particles in the portion of drum exhaust which flows to the burner 11 from conduit 16 are removed by a cyclone separator 20. A recycle fan 21 passes the recirculation gases from the separator to the duct 22 which feeds the gases to the burner 11. The duct 22 also includes a diffuser portion 23 for control of the gases to the burner.

RAP to be processed is supplied to the drum 10 by the conveyor 25 which feeds a slinger conveyor 26. The slinger inserts the RAP into the drum 10. The input end of the drum 27 is raised to a higher level than the exit end 28. This allows the RAP to move downward as it moves forward in the drum. The angle of the drum determines the rate of flow through the drum and can be adjusted to match flow rates required by other components of the system. The input region has drum flights which provide no lift to the RAP, and which move the RAP along the bottom of the drum and forward in direction. This input region is approximately three feet long. The hot gases from the burner 11 pass over the top of the moving rap in the input region.

Figure 2:
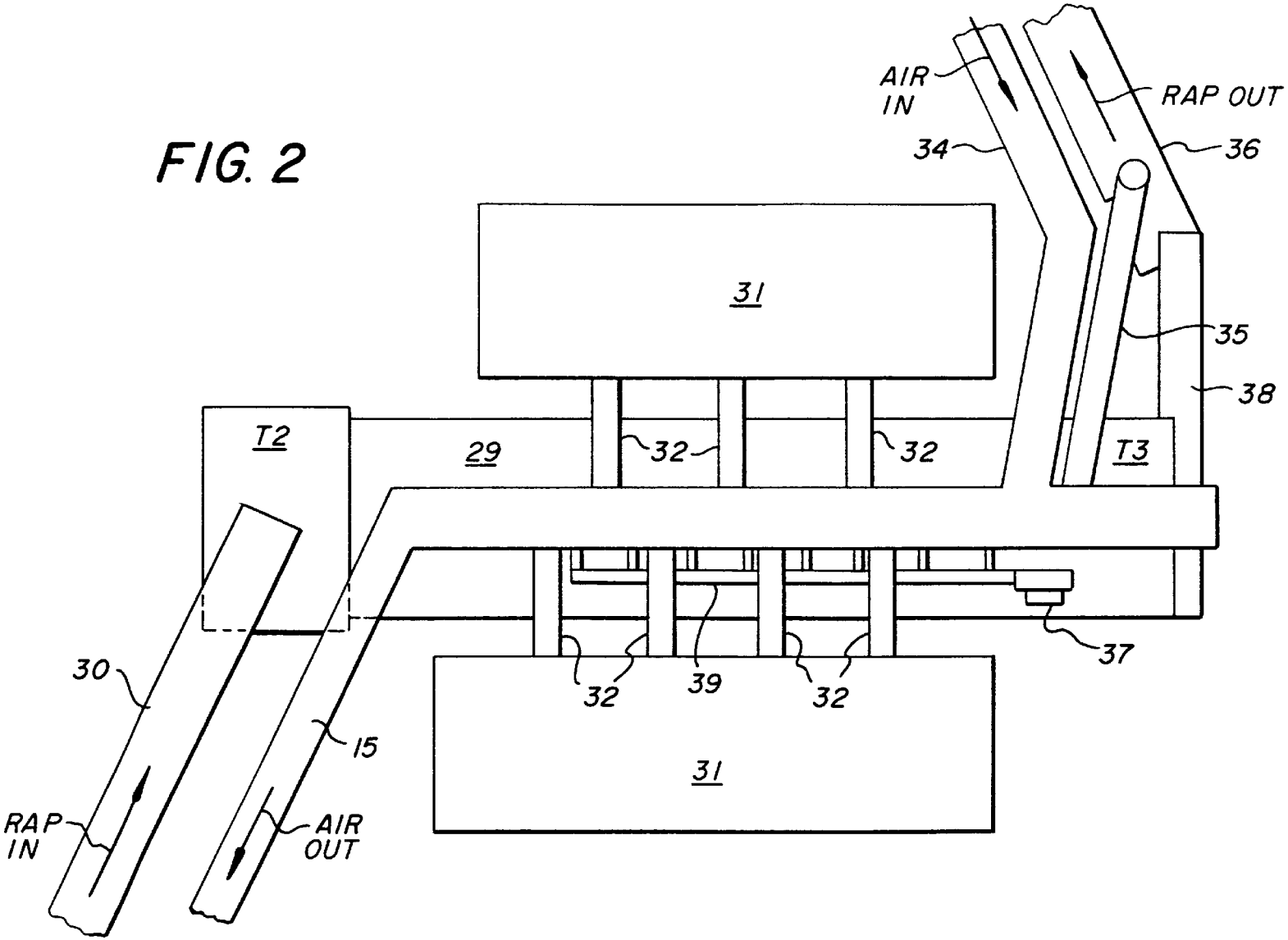
FIG. 2 shows a plan view of the microwave treatment tunnel with input and output connections.

The RAP which is processed by the drum 10 is fed out on a conveyor 30 which moves it to the microwave heating step. FIG. 2 shows the microwave processing unit 29 which receives the RAP from the drum dryer 10 and conveyor 30.

The microwave processing unit is a conveyor tunnel which feeds a stream of RAP under seven separate microwave antennas which are energized by seven transmitters 31 through wave guides 32. The RAP is spread out on the conveyor, and as the RAP stream passes under the antennas the temperature is raised to the final desired output temperature. Ideally, the drum dryer should raise the temperature as high as possible without causing smoking of the RAP and then the microwave unit should provide the last increment of heat required to obtain the final RAP temperature.

The air exhaust 15 from the microwave treatment tunnel is connected to the burner fan 24 as shown in FIG. 1. The air supplied to the microwave tunnel 29 is air which has previously passed over another RAP processing step, such as silos which load product into trucks, or a mill where additives are put into the RAP. The air from duct 34 is used to sweep hydrocarbon fumes from these other steps. The hydrocarbon fumes particles are ultimately burned at burner 11. The fumes from conveyor 36 are picked up by drawing in some air from duct 35 which picks up fumes from mixer 38 as well as conveyor 36. Mixer 38 may be used to mix in additives or rejuvenating materials into the heated RAP.

Coolant is supplied to the seven microwave transmitters as is required, and the wave guides are provided with purging air from fan 37 through duct 39.

The critical temperature of this apparatus is the temperature of the gases entering the drum 10 from the burner 12. This input region temperature must be limited to an amount which is slightly less than that which causes smoking of the RAP. It has been found that the maximum temperature $T_1$ should be 1200 degrees Fahrenheit. This is a maximum temperature which can be used and still prevent smoking of the input RAP. The temperature T1 is taken in the input region where the RAP moves forward, but is not lifted by the drum flights. The fall region of the drum begins downstream from the input where the flights raise the RAP and allow it to fall in a veil down to the bottom of the drum.

The temperature T1 may be measured, and the electrical signal indicative of this temperature may be used as a feed back signal to control the burner firing rate and/or the quantity of recirculation gases from duct 16 and cyclone separator 20.

The temperature of the RAP (T2) is measured at the input of the Microwave tunnel and this temperature (T2) is controlled by varying the flow rate (pounds of RAP per minute) through the drum dryer. The slower the flow rate, the longer the RAP will be subjected to the hot gases from the burner, and the higher the temperature $T_2$ will be. The temperature T2 is also varied by changing the firing rate of the burner which heats gases for the drum dryer. The temperature T2 is between two hundred and three hundred degrees Fahrenheit.

The an electrical signal representing temperature T2 may be fed back to the controls for the firing rate of burner 12 and the control for the flow rate through the drum 10 (the angle of the drum controls flow rate). This temperature T2 may also be used as a feed back signal to control the rate of input of RAP to the system from the slinger 26 and conveyor 25.

The temperature of the RAP at the exit of the microwave tunnel 29, $T_3$, is nominally 300 degrees Fahrenheit. This temperature is partially controlled by control of the flow rate of the RAP through the microwave unit. The slower the flow rate, the higher the output temperature of the RAP from the microwave unit.

The temperature T3 is also controlled by the entire RAP treatment process which precedes. Therefore an electrical feedback signal representative of T3 may be used to provide control signals for the system variables which comprise the drum angle (flow rate), the burner firing rate, the feed back rate of the gases from cyclone separator 20, the microwave power level, and/or the microwave tunnel flow rate.

The feedback signals representing temperatures T1, T1a, T2, and T3 may be used with an automatic control system for adjusting the system variables, or they may be used to provide information to a control operator (a man in the loop) who adjusts system variables in accordance with measured temperatures.

The microwave unit 29 is the most expensive apparatus in this process, and is therefore the one with the least flow rate capacity. The capacity of the drum dryer should be greater than the microwave unit so that sufficient RAP is always available for the microwave unit. With sufficient RAP available to the microwave unit, it can always be used at its maximum capacity and therefore at its most economical operating level. This will require adjustment of the firing rate, the drum angle, the recirculation percentage of gases from cyclone separator 20, and the microwave tunnel conveyor speed to achieve the maximum heating rate from the microwave magnetrons which are most economical at full power.

The microwave unit can also be controlled by adjusting the power input to the magnetrons 31. If this approach is used, the output temperature (T3) may be varied while the RAP flow rate through the microwave unit remains constant.

The operation of the parallel flow system is best understood by considering first the output temperature $T_3$. Temperature T3 may be controlled by the RAP flow rate in the microwave unit 29 and all of the variables which are up stream from the location of T3. Since the flow rate from the drum 10 to the microwave unit 29 cannot exceed the flow rate through the microwave unit for any significant period of time, the flow rate in the drum must be the same as in the microwave unit during steady state conditions. This means that the flow rate of the drum 10 will be determined by the flow rate through the microwave unit 29.

The RAP temperature $T_1$ is taken by measuring the gas and vapor temperature at a point above the RAP in the input to the drum where there is no RAP falling within the drum. There is no temperature probe inserted into the RAP because of difficulty of construction and maintenance required for such a probe. The drum input has an initial 3 feet where there is no lift given to the RAP which means that the RAP will not rise up and fall down in this region. The movement of the RAP in this area appears more like a conveyor belt where the stream of RAP moves forward only by the screw action of the drum flights. When the RAP passes beyond the initial 3 feet, the flight change to lifting and the RAP is cause to shower down inside of the drum creating a veil of RAP which intersects the hot gases from the remote burner.

This temperature T1 is affected indirectly by the moisture and temperature of the heated RAP. Where the temperature of the RAP is being raised to a high temperature and the flow rate is low, the temperature $T_1$ will rise because heat from the input will not be absorbed as rapidly by the hotter RAP in the drum. Therefore, when the flow rate of the drum changes as a function of drum angle, the firing rate of the burner must also change.

The temperature T0 is taken at the burner and is the initial temperature of the gases after the flame. The heat measurement at this location is used to control possible smoking of the RAP at the input of the drum or down stream of the input. Lowering T0 reduces the temperature through out the drum 10. T0 is controlled by adjusting the firing rate and/or the rate of feed back of gases from the drum exhaust at duct 16.

The temperature T1a is taken inside the drum and approximately 10 feet down stream from the input region where T1 is measured. Temperature T1a is measured at a point above the floor of the drum where the hot gases are flowing through the shower or veil of RAP. Feedback of the temperature T1a may be used to adjust the burning rate and/or the feedback of gases from exhaust duct 16, and the flow rate of RAP by adjusting the angle of the drum.

If the rate of drum RAP flow is low, the temperature $T_1$ will rise above 1200 degrees (a maximum temperature where there is no smoking of wet entering RAP) and the burner 11 firing rate will have to be cut back to prevent overheating and smoking at the input and in the drum dryer. The percentage of exhaust gas feedback may also be varied to adjust T1, to the extent possible where there is no measurable $NO_x$ produced by the burner 11 and chamber 12.

Counter Flow Design

Figure 3:
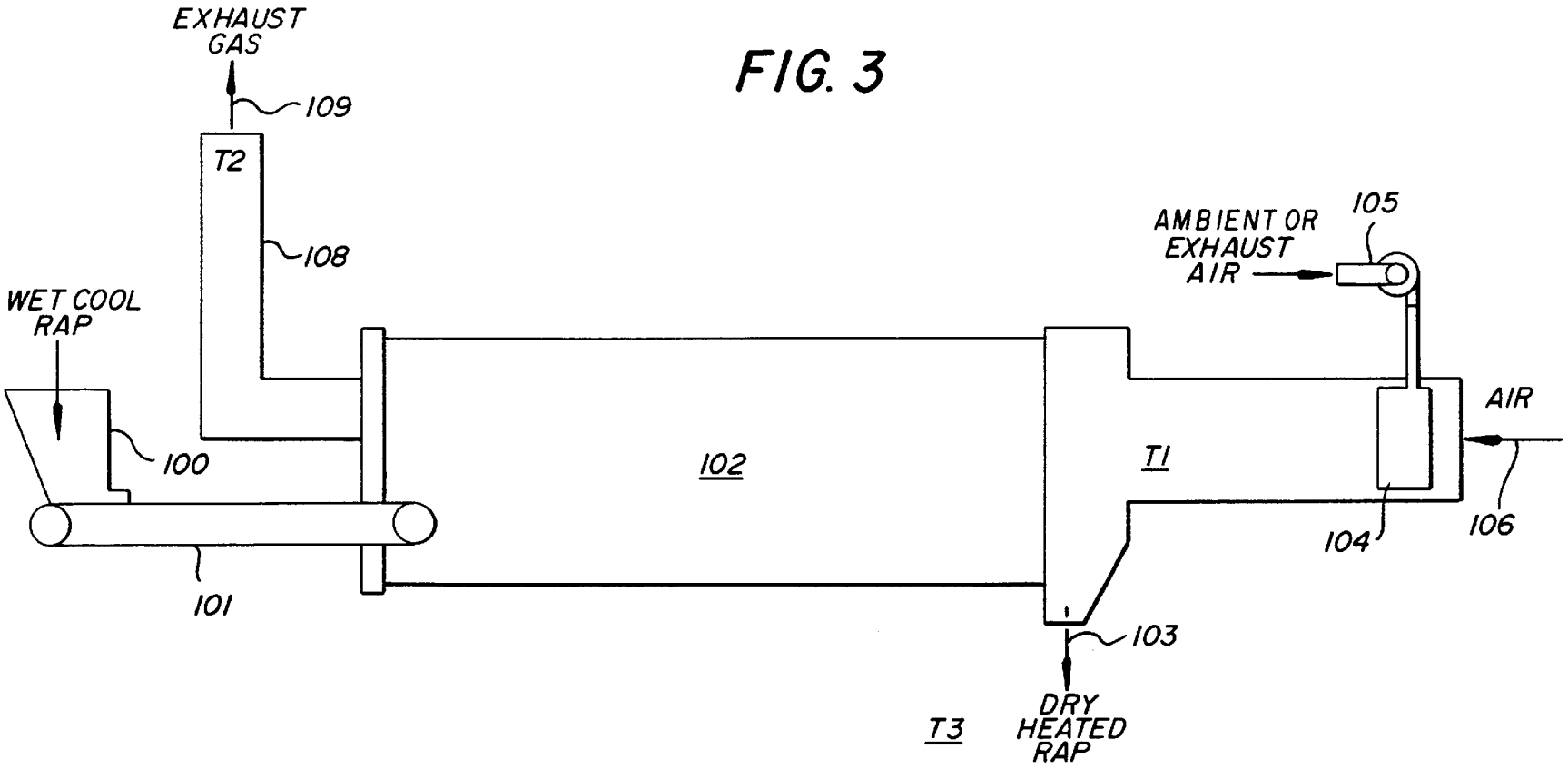
FIG. 3 shows a plan view of a counter flow RAP drum with input combustion chamber and output connections.

In FIG. 3 there is shown a counter flow drum dryer. In this embodiment, the RAP enters the drum at the exit end for the exhaust and leaves the drum at the entrance point of the hot gases from the burner. This arrangement assures that the coolest RAP is contacted by the cool gases and the warmest RAP is contacted by the hottest input gases. This provides for transfer of the greatest amount of heat to the RAP, or the highest system efficiency. The exit temperature of the gases may be within 100 degrees F. or less of the entering RAP, or at a temperature of 150 to 200 degrees F.

The preferred input temperature of the gases has been found to be approximately 1100 degrees F. This temperature produces very little smoke, degradation of the RAP, or incineration of the fines. The burner is a Low Nox burner of the type described above and used with the parallel flow designs of FIGS. 1 and 2. The exhaust gases are fed to a bag house or other apparatus for cleaning. The exhaust gases may also be cleaned with a slinger type draft fan which will concentrate the fines and hydrocarbon droplets in a periphery of the exhaust.

In the cool flow counterflow design of FIG. 3 it has been found that there is no reason to return the exhaust gases to the burner input for cooling of the burner and input air because the exhaust gases contain very little heat (less than 100 degrees F. higher than the input RAP) and contain substantial amounts of water in the form of vapor or droplets. Therefore, the cooling air to the burner may be ambient air which is not burdened with the water from the exhaust.

It is also contemplated that this counter flow design may be used with a microwave treatment apparatus located down stream. The microwave can be used for further heating of the RAP to a higher end temperature and for strengthening the RAP by microwave treatment of the asphaltic binder.

As shown in FIG. 3, the RAP enters the drum at a hopper 100 and is moved to the drum 102 by the conveyor 101. The drum 102 has a slight tilt to its longitudinal axis and slopes down from the input end of the RAP drum to the output at 103. The hot gases are generated by an Eclipse burner 104 which may be supplied with combustion air from fan 105 which may receive exhaust air from a microwave heater unit, or from ambient air. There is also a separate supply of ambient air 106 which is used to cool the burner gases to approximately 1100 degrees F. prior to entering into the drum and coming into contact with the hot RAP in the drum. A burner tube 107 is used to connect the burner to the drum. Tube 107 may be equipped with baffles 112 which shield the RAP from the burner radiant heat, and prevent excessively hot gas laminations, salients or spikes from the hot gas supply from entering into the drum. The burner tube 107 may also be constructed so that there is a bend or turn which shields the RAP from the infra red heat from the flame.

The burner tube 107 may also include turbulence inducers 113 and or baffles 112 to shield radiant heat from entry into the drum. The drum 102 also includes flights 111 for raising the RAP and allowing it to fall within the drum, as well as urge the RAP towards the drum exit.

The drum 102 may be provided with flighting 111 bolted in the drum. The flighting can be adjusted by adding or removing for the purpose of adjusting the thickness of the RAP veil falling in any section of the drum. Changes in the flighting can effectively increase or decrease the amount of RAP contact in the drum. By control of the veil, the entering gas temperature at point $T_1$ can be increased. The increase is possible because the veil has more free air passages. Still further, the flighting can be adjusted to provide different heating conditions in different sections of the drum. The flighting can also be adjusted to control the rate of RAP movement through the drum in cooperation with the longitudinal angle of the drum and drum turning speed.

The air exhaust 108 feeds out from the cool end of the drum and may be dumped directly to the atmosphere if environmental conditions permit, or further cleaned in a cleaning step such as a bag house or a slinger fan 109.

In FIG. 3 there is shown a drive motor (114) connected to a drive means such as a chain (115). The motor (114) and chain (115) are used to drive the drum (102).

Control of the process is provided by adjustment of the drum longitudinal angle, by adjustment of the firing rate, by adjustment of the amount of ambient air 106, by adjustment of the rate of RAP input, and/or by adjustment of the drum flighting. Control is effected by temperature measurements which include the temperature of the incoming RAP at 101, the temperature of the exhaust gases ($T_2$), the temperature of the input gases ($T_1$), and the temperature of the exit RAP ($T_3$).

The process may be controlled by a computer which receives as inputs $T_1$, $T_2$, and $T_3$. The drum through put is adjusted by the rate of input from the conveyor 101 and by the longitudinal tilt of the drum 102. The tilt may be mechanically or hydrauliclly controlled and the computer may be used to control the tilt by control of servo mechanisms having feed back of position to the computer. Based upon each drum and burner configuration, empirically generated curves may be constructed which will permit the computer to predict which drum angle will produce a desired through put of RAP. In practice, it has been determined that the temperature $T_1$ should be approximately 1100 degrees F., that $T_2$ should be less than 100 degrees higher than the input RAP temperature, and that $T_3$ should be in the order of 300 to 350 degrees F.

In operation, it has been found that the oxygen levels of the gases entering the drum are approximately 18%, and that the exit level is approximately the same. Therefore, it is believed that the elimination of the emission of smoke and degradation of the asphaltic compounds is not a result of reduced oxygen available for combination with the asphalt. Still further, it is believed that the oxygen in the input stream is combined with the hydrocarbons of the asphaltic compounds by adding oxygen atoms to the long organic chains. It should be noted that this is not combustion, but addition of oxygen to the molecules without breaking up the chains and without production of excessive heat or combustion. This oxygenating results in hardening the asphalt product.

In the counter flow embodiment it has been confirmed that a much smaller portion of the asphaltic compounds boil off or are cracked into smaller volatile molecules when the hot gases that strike the exiting RAP at the gas input are essentially dry and free of the steam that causes steam cracking of the larger asphalt molecules into smaller hydrocarbons that are gaseous at the temperature of the exhaust. These hydrocarbon vapors are then condensed back into the cooler RAP during exit of the gases where the stream contacts RAP at cool ambient temperatures. This produces a clean output which can conform to air pollution standards which limit hydrocarbon vapor emission.

A method of treating asphalt with a counter flow drum wherein the moisture is removed from the RAP prior to the contact of the RAP with the elevated temperatures of input gases from the burner, whereby the steam cracking of asphalt is essentially eliminated. The counter flow results in a sequence of drying the RAP with lowest temperature gases just prior to their exit, with the evaporated moisture in the exhaust stream. The rapid cooling of the gas in the evaporative drying zone also produces conditions that precipitate many contaminants which would remain gaseous in hotter gas streams. Because of the elimination of steam-cracking-produced pollutants, it has proven possible to have higher temperatures of the incoming dry air from the burner. This air, which contacts the RAP just prior to exit, results in the higher rate of heat transfer possible with the greater temperature differentials, thus increasing the production rate of heated material for a given size of drum, air flow, and energy input, as compared to a parallel flow design.

Although the invention has been shown and described with respect to a best mode embodiment thereof, it should be understood by those skilled in the art that the foregoing and various other changes, omissions and deletions in the form and detail thereof may be made therein without departing from the spirit and scope of this invention.

We claim:

1. An apparatus for the manufacture of a hot mix asphalt (HMA) from a recycled asphalt pavement (RAP) comprising:

(a) a counter flow rotary drum dryer for heating said RAP to a desired temperature, said RAP flowing through said drum dryer, said drum dryer having two opposite ends and comprising:
  (i) a RAP output,
  (ii) a RAP input,
  (iii) an input for entering combustion gases having desired temperatures and which flow thereafter in the drum dryer, and
  (iv) an exhaust output for combustion gases and vapors; said combustion gases and vapors having desired temperatures;

(b) means for supplying said RAP to said RAP input, (c) a low $NO_x$ burner connected to said drum dryer for producing a flame; said burner positioned with respect to said drum dryer in such a way that the flame does not directly radiate energy to the RAP flowing through said drum dryer;

(d) a means for supplying combustion air to an air inlet of the burner; and (e) a combustion gas air supply means for supplying a quantity of cooling air immedediately ahead of said burner and for producing complete combustion of fuel at a temperature which is below that which produces significant measurable $NO_x$ in the combustion gases; wherein said exhaust and RAP outputs are located on said opposite ends of said drum dryer.

2. The apparatus of claim 1, further comprising (a) a means to limit the temperatures of the combustion gases at the input for entering combustion gases to less than that which causes smoking and (b) a means to eliminate an infra-red-radiation heat produced by said flame.

3. The apparatus of claim 1 wherein the low $NO_x$ burner produces temperatures of the combustion gases at the input for entering combustion gases of about 1,100° F.

4. The apparatus of claim 1, further comprising an extended duct which is at least 5 feet long for containing the combustion gases and for connecting the burner to the drum dryer.

5. The apparatus of claim 1, further comprising a duct having a bend, said duct being positioned between the burner and the drum dryer.

6. The apparatus of claim 1, further comprising a duct having baffles which prevent excessively hot combustion gases from reaching the drum, said duct being positioned between the burner and the drum dryer.

7. The apparatus of claim 1, wherein the low $NO_x$ burner produces temperatures of said combustion gases entering said drum which are 1,100°±100° F.

8. The apparatus of claim 1, wherein the low $NO_x$ burner produces a temperature of said RAP at any point in said drum which does not exceed 350° F.

9. The apparatus of claim 1, wherein the low $NO_x$ burner produces gases which contact said RAP in said drum which do not exceed temperatures which produce smoking of said RAP.

10. The apparatus of claim 1, wherein said burner is supplied with gases, said gases being in larger amounts that which are required for a designed combustion by said burner.

11. The apparatus of claim 1, wherein said burner is supplied with ambient air in an amount which is sufficient to provide a short burn time of the flame so as to prevent creation of $NO_x$ during a combustion process.

12. The apparatus of claim 1, wherein said burner is supplied with ambient air in an amount which prevents a temperature of the flame from being sufficiently high to create $NO_x$ during the combustion process.

13. The apparatus of claim 1, wherein the low $NO_x$ burner produces a temperature of said combustion gases entering said drum which is at least 1,000° F.

14. The apparatus of claim 1, wherein the low $NO_x$ burner produces a temperature of said combustion gases entering said drum which is in the range of about 900° to about 1,300° F.

15. The apparatus of claim 1, wherein the low $NO_x$ burner produces a temperature of the combustion gases at the input for entering combustion gases of said drum dryer which is about 1,200° F.

16. The apparatus of claim 1, wherein the temperature of the combustion gases entering said drum dryer is dependent on a firing rate of said burner.

17. The apparatus of claim 1, wherein a temperature of the RAP at said RAP output is controlled by adjusting the rate of flow of RAP through the drum dryer.

18. The apparatus of claim 1, wherein a temperature (T1) of said RAP at said RAP output is controlled by adjusting a firing rate of said burner to the highest rate where there is no smoking of the RAP.

19. The apparatus of claim 1, wherein:

(a) a temperature (T1a) of the gases in the drum is measured at a point downstream from said input for entering combustion gases and prior to the exit of said RAP from said drum; and (b) a burning rate of the burner is a function of the temperature (T1a).

20. The apparatus of claim 1, wherein said drum dryer further includes flights for lifting said RAP so as to allow said RAP to fall through the gases flowing in said drum dryer.

21. The apparatus of claim 1, wherein the low $NO_x$ burner is mounted on an axis which is the same as a longitudinal axis of the drum, and a burner tube connecting the burner to the drum incorporates baffles to shield said RAP from a radiant heat generated by the flame.

22. The apparatus of claim 21, wherein said baffles further prevent insertion of excessively hot gas regions in the drum.

23. The apparatus of claim 1, wherein the low $NO_x$ burner is mounted on an axis which is the same as a longitudinal axis of the drum, and a burner tube connecting the burner to the drum incorporates turbulence inducers to shield said RAP from a radiant heat generated by the flame.

24. The apparatus of claim 1, wherein said burner is supplied with gases in amounts which prevent the flame from reaching a temperature sufficient to create $NO_x$ during the combustion process.

25. A low $NO_x$ drum dryer for heating recycled asphalt pavement materials comprising in combination:

(a) a counter flow rotary drum comprising:

(i) a recycled asphalt pavement (RAP) input, (ii) a RAP output, (iii)a gas input, and (iv) an exhaust;

(b) a low $NO_x$ burner means for producing a flame and generating a low amount of $NO_x$ located at a position with respect to said drum which prevents said flame from entering said drum;

(c) a means for supplying combustion air to an air inlet of the burner means;

(d) a combustion gas air supply means for supplying a quantity of cooling air immediately ahead of said low $NO_x$ burner means and for producing complete combustion of fuel at a temperature which is below that which produces significant measurable $NO_x$ in the combustion gases; and (e) a duct for supplying said combustion gases to said drum gas input from said burner means.

26. A low $NO_x$ dryer drum for heating recycled asphalt pavement materials comprising in combination;

a counter flow rotating drum dryer having a recycled asphalt pavement (RAP) input and output and having a gas input and an exhaust;

a low $NO_x$ burner means for producing emissions having low amounts of $NO_x$;

a means for supplying combustion air to an air inlet of the burner means;

a combustion gas air supply means for supplying a quantity of cooling air immedediately ahead of said burner means and for producing complete combustion of fuel at a temperature which is below that which produces significant measurable $NO_x$ in the combustion gases; and means for supplying said combustion gases to said dryer drum gas input.

27. An apparatus for the production of a hot mix asphalt (HMA) from a recycled asphalt pavement (RAP) comprising in combination:

(a) a counter flow drum dryer having a RAP input and a RAP output;

(b) a hopper storage means and a conveyor means for moving RAP from said hopper storage means to said drum dryer;

(c) a burner means located remotely from said drum dryer for supplying combustion gases having a low $NO_x$ content to said drum dryer;

(d) a means for supplying combustion air to an air inlet of the burner means:

(e) a combustion gas air supply means for supplying a quantity of cooling air immediately ahead of said burner means and for producing complete combustion of fuel at a temperature which is below that which produces significant measurable $NO_x$ in the combustion gases;

(f) a hot gas duct means connected to said burner means and to said drum for transmitting said combustion gases to said drum; and (g) means for rotating said drum for mixing said RAP, for moving RAP through said drum, and for allowing different surfaces of said RAP to come into contact with said combustion gases.

28. An apparatus for the manufacture of a hot mix asphalt (HMA) from a recycled asphalt pavement (RAP) comprising:

(a) a counter flow rotary drum dryer for heating said RAP to a desired temperature, said RAP flowing through said drum dryer, said drum dryer having two opposite ends and comprising:

(i) a RAP output, (ii) a RAP input, (iii) an input for entering combustion gases; said combustion gases having temperatures in the range of about 900° F. to about 1,300° F. and which flow thereafter in the drum dryer, and (iv) an exhaust output for combustion gases and vapors; said combustion gases and vapors having predetermined temperatures;

(b) means for supplying said RAP to said RAP input, (c) a combustion burning means connected with said drum dryer; said burning means having a low $NO_x$ burner for producing a flame; said burner producing said input temperature range; said burner positioned with respect to said drum dryer in such a way that the flame does not directly radiate energy to the RAP flowing through said drum dryer;

(d) a means for supplying combustion air to an air inlet of the burner;

(e) a combustion gas air supply means for supplying a quantity of cooling air immedediately ahead of said burner and for producing complete combustion of fuel at a temperature which is below that which produces significant measurable $NO_x$ in the combustion gases; and (f) a means to eliminate an infra-red radiation heat produced by an open flame, wherein said exhaust and RAP outputs are located on said opposite ends of said drum dryer, and wherein a temperature of said RAP at any point in said drum dryer does not exceed 350° F.

29. The apparatus of claim 28, further comprising an extended duct which is at least 5 feet long for containing the combustion gases and for connecting the burner to the drum dryer.

30. The apparatus of claim 28, further comprising a duct having a bend, said duct being positioned between the burner and the drum dryer.

31. The apparatus of claim 28, wherein said means to limit the temperatures of the combustion gases at the input to less than that which causes smoking comprise a duct having baffles which prevent excessively hot combustion gases from reaching the drum, said duct being positioned between the burner and the drum dryer.

32. The apparatus of claim 31, wherein the low $NO_x$ burner is mounted on an axis which is the same as a longitudinal axis of the drum, and the duct further comprises a turbulence inducer to shield said RAP from a radiant heat generated by the flame.

33. The apparatus of claim 32, wherein:

(a) a temperature (T1a) of the gases in the drum is measured at a point downstream from said input for entering combustion gases and prior to the exit of said RAP from said drum; and (b) a burning rate of the burner is a function of the temperature (T1a).

* * * * *